US010544949B1

(12) United States Patent
Chang

(10) Patent No.: US 10,544,949 B1
(45) Date of Patent: Jan. 28, 2020

(54) AIR CIRCULATION APPARATUS FOR BUILDING

(71) Applicant: Ting-Chia Chang, Taichung (TW)

(72) Inventor: Ting-Chia Chang, Taichung (TW)

( * ) Notice: Subject to any disclaimer, the term of this patent is extended or adjusted under 35 U.S.C. 154(b) by 0 days.

(21) Appl. No.: 16/029,650

(22) Filed: Jul. 9, 2018

(51) Int. Cl.
*F24F 7/02* (2006.01)
*F24F 7/04* (2006.01)

(52) U.S. Cl.
CPC ..... *F24F 7/02* (2013.01); *F24F 7/04* (2013.01); *F24F 2221/52* (2013.01)

(58) Field of Classification Search
CPC ..... F24F 7/02; F24F 7/04; F24F 2221/52
See application file for complete search history.

(56) References Cited

U.S. PATENT DOCUMENTS 4,621,569 A * 11/1986 Fioratti ..... A01K 1/0058 454/364
4,848,653 A * 7/1989 Van Becelaere ..... F24F 7/02 236/49.3
6,138,424 A * 10/2000 Akerson ..... F24F 13/082 454/279
2004/0000101 A1* 1/2004 Dixon ..... E04D 13/174 52/43
2012/0266975 A1* 10/2012 Kelly ..... E04B 1/7038 137/357
2017/0176029 A1* 6/2017 Wilding ..... F24F 7/02

* cited by examiner

*Primary Examiner* — Ryan A Reis

(57) ABSTRACT

An air circulation apparatus is fixed on a building and contains: multiple intake systems, a first exhaust system, and multiple second exhaust systems. Each of the multiple intake systems includes a first cover, a second cover, an entrance, a first partition, a second partition, a water guide sheet, and a water outlet. The first exhaust system includes two shells, two first orifices, a third partition, two fourth partitions obliquely, and two opposite fifth partitions. Each of the multiple second exhaust systems includes a first lid, a second lid, a second orifice, a fifth partition, a first accommodation plate, a second accommodation plate, a third orifice, two fourth orifices, and a discharge pipe, wherein the first lid has a first extension, and the second lid has a second extension.

4 Claims, 8 Drawing Sheets

AIR CIRCULATION APPARATUS FOR BUILDING

FIELD OF THE INVENTION

The present invention relates to an air circulation apparatus for a building which discharges hot airs effectively and avoid rainwaters dropping into the building.

BACKGROUND OF THE INVENTION

A conventional building (such as factory or warehouse) is stuffy and airs cannot circulate in the building, so air fans are mounted inside the building so as to cool the building.

However, the air fans will consume electricity to increase operation cost, and rainwaters will drop into the building easily in a rainy day.

SUMMARY OF THE INVENTION

The primary aspect of the present invention is to provide an air circulation apparatus for a building which discharges hot airs effectively.

Another aspect of the present invention is to provide an air circulation apparatus for a building which avoids rainwaters dropping into the building.

DETAILED DESCRIPTION OF THE PREFERRED EMBODIMENTS

Figure 1:
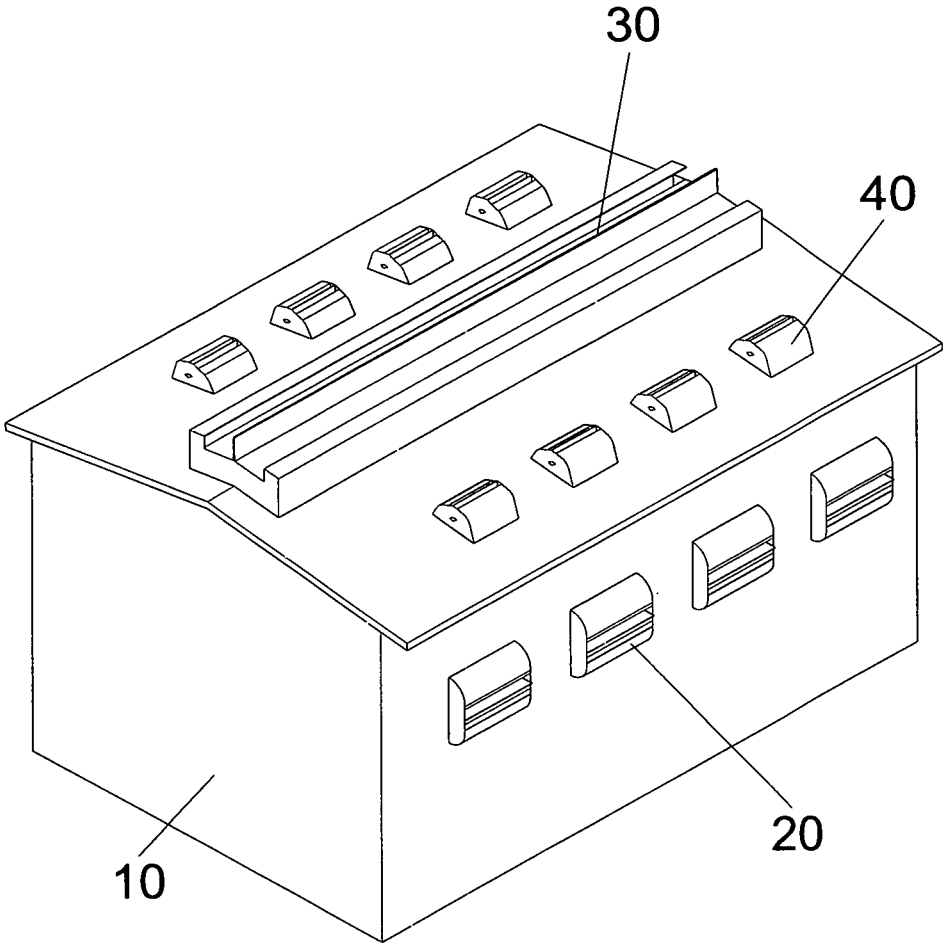
FIG. 1 is a perspective view showing the assembly of an air circulation apparatus for a building according to a preferred embodiment of the present invention.

With reference to FIG. 1, an air circulation apparatus is fixed on a building 10 according to a preferred embodiment of the present invention and comprises: multiple intake systems 20, a first exhaust system 30, and multiple second exhaust systems 40. The multiple intake systems 20 are mounted on an external wall 11 of the building 10, the first exhaust system 30 is arranged on a top of a roof 13 of the building 10, and the multiple second exhaust systems 40 are respectively secured on two tilted faces of the roof 13 beside the top of the roof 13.

Figure 2:
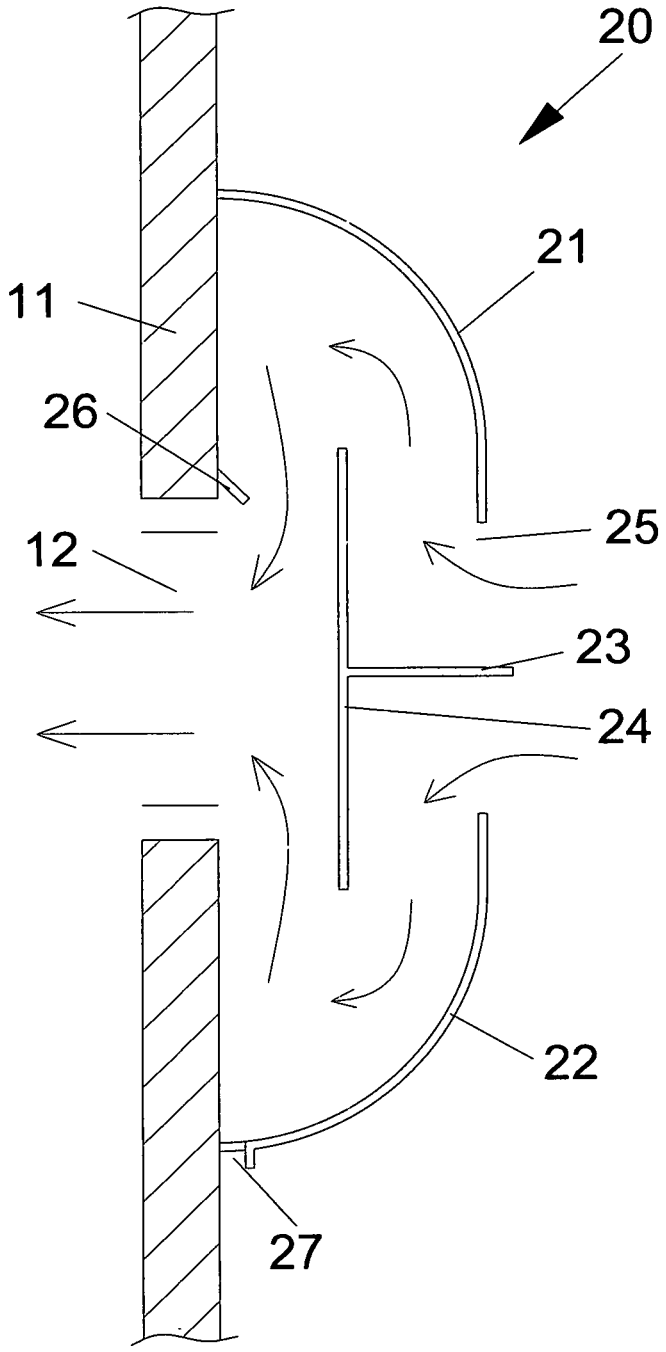
FIG. 2 is a cross sectional view showing the operation of the air circulation apparatus for the building according to the preferred embodiment of the present invention.

Referring to FIG. 2, each of the multiple intake systems 20 includes a first cover 21 disposed above an inlet 12 of the external wall 11 of the building 10, a second cover 22 mounted below the inlet 12 of the external wall 11 of the building 10, an entrance 25 defined between the first cover 21 and the second cover 22, a first partition 23 mounted on a central position of the entrance 25, a second partition 24 vertically connected with the first partition 23 proximate to the inlet 12, a water guide sheet 26 arranged on an upper portion of the external wall 11 of the building 10 outside the inlet 12, and a water outlet 27 formed on a bottom of the second cover 22, wherein a diameter of the entrance 25 is less than the inlet 12. Thereby, when external airs flow into the entrance 25, they are separated by the first partition 23 to further flow into the inlet 12 via a first channel among the first cover 21, the second partition 24, and the external wall 11 of the building 10 and via a second channel among the second cover 22, the second partition 24, and the external wall 11, thus flowing the airs into the building 10 so as to cool the building.

Figure 3:
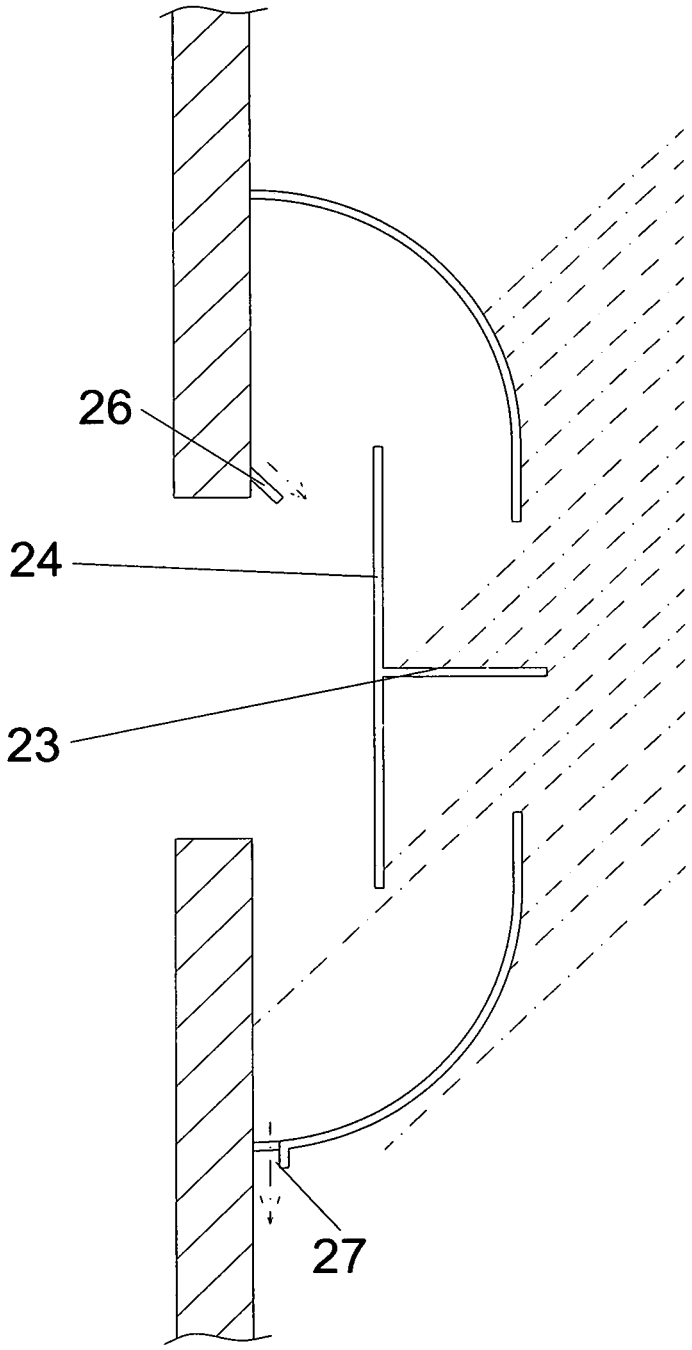
FIG. 3 is another cross sectional view showing the operation of the air circulation apparatus for the building according to the preferred embodiment of the present invention.

As shown in FIG. 3, when the rainwaters spray into the entrance 25 in a rainy day, most of the rainwaters are stopped by the first partition 23, wherein some of the other rainwaters inside the second cover 22 do not accumulate by way of the water outlet 27, and the other rainwaters inside the first cover 21 are guided by the water guide sheet 26 to drop out of the water outlet 27, thus avoiding the rainwaters dropping into the inlet 12 of the building 10.

Figure 4:
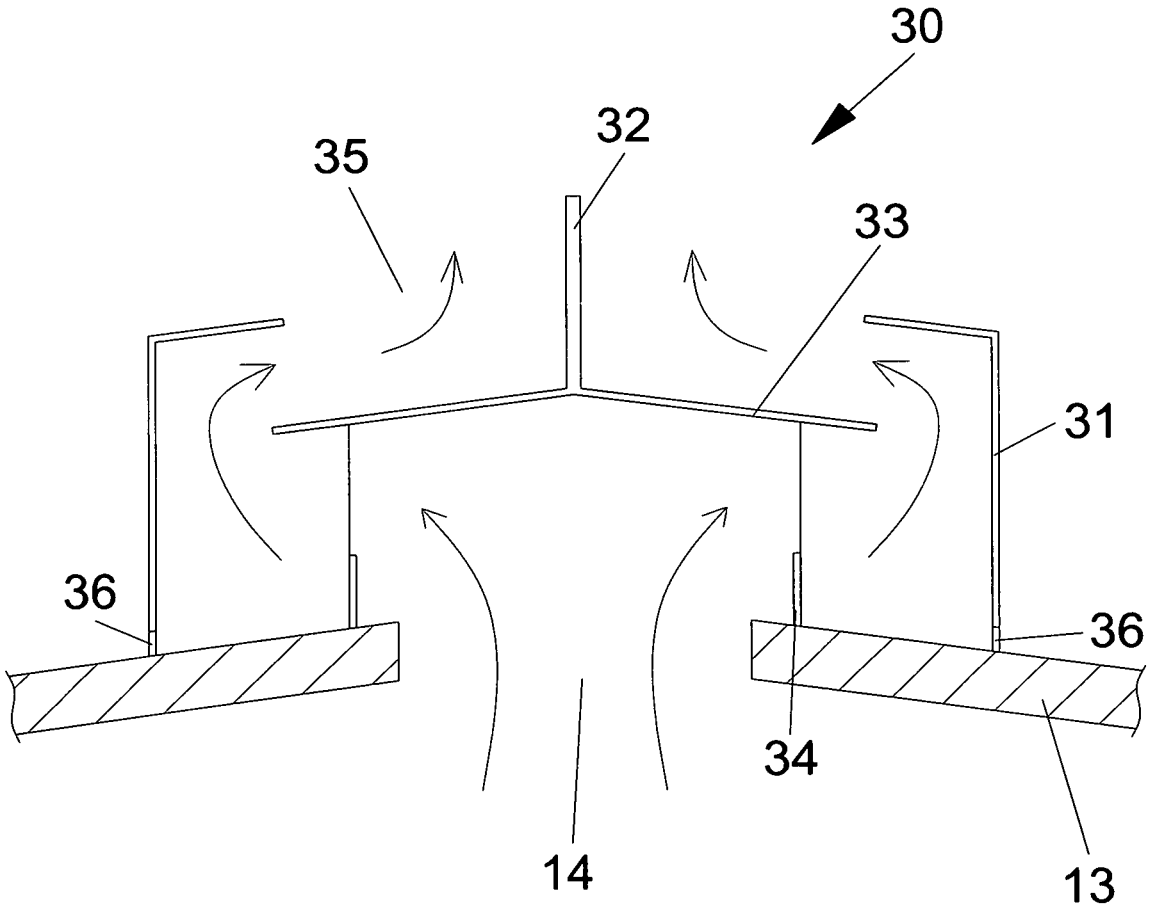
FIG. 4 is also another cross sectional view showing the operation of the air circulation apparatus for the building according to the preferred embodiment of the present invention.

As illustrated in FIG. 4, When hot airs flow into a first opening 14 of the top of the roof 13 from the building 10, they are separated by the two fourth partitions 33 to further flow out of two second openings 35 beside the third partition 32 via two third channels among the two opposite fifth partitions 34, the two shells 31, and the two fourth partitions 33, thus exhausting the hot airs efficiently. Preferably, a diameter of the first opening 14 is more than each of the two second openings 35.

Figure 5:
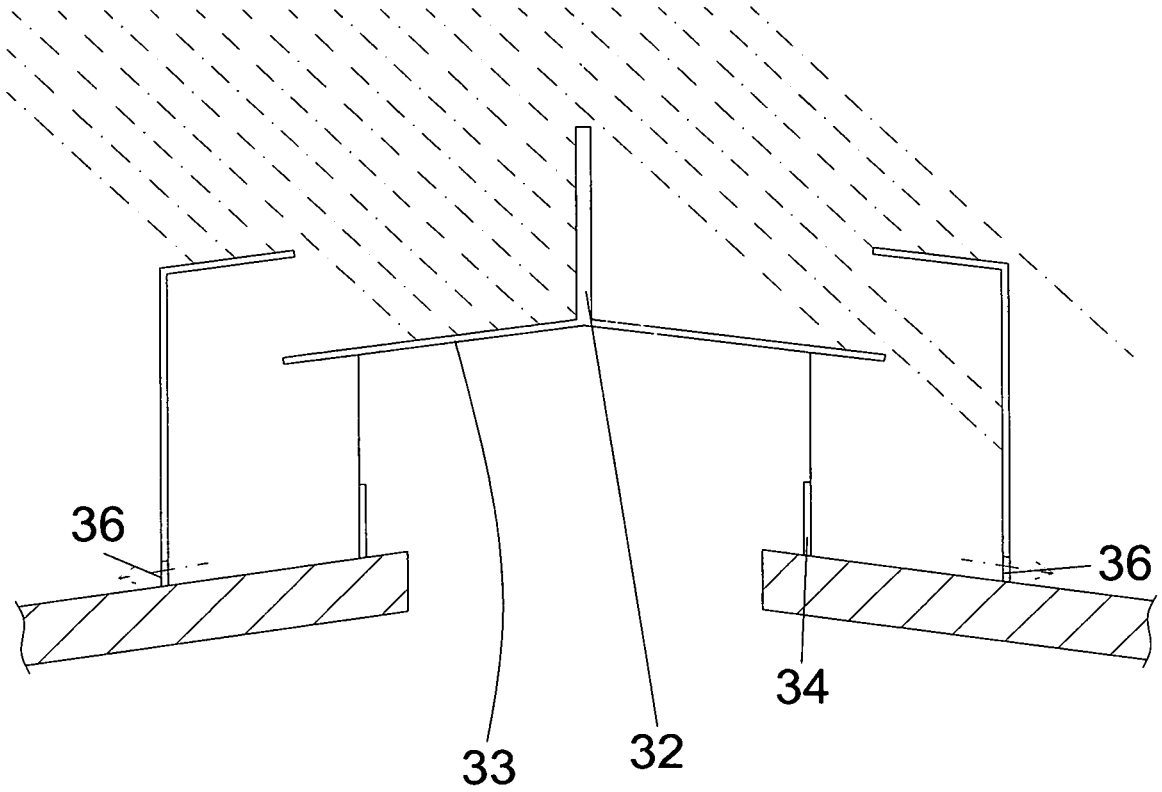
FIG. 5 is still another cross sectional view showing the operation of the air circulation apparatus for the building according to the preferred embodiment of the present invention.

With reference to FIG. 5, when the rainwaters spray into two second openings 35 in the rainy day, they are stopped by the third partition 32 mostly, wherein some of the other rainwaters inside the two shells 31 do not accumulate by way of the two first orifices 36, and the other rainwaters are stopped by the two opposite fifth partitions 34 so as to avoid dropping into the first opening 14.

Figure 6:
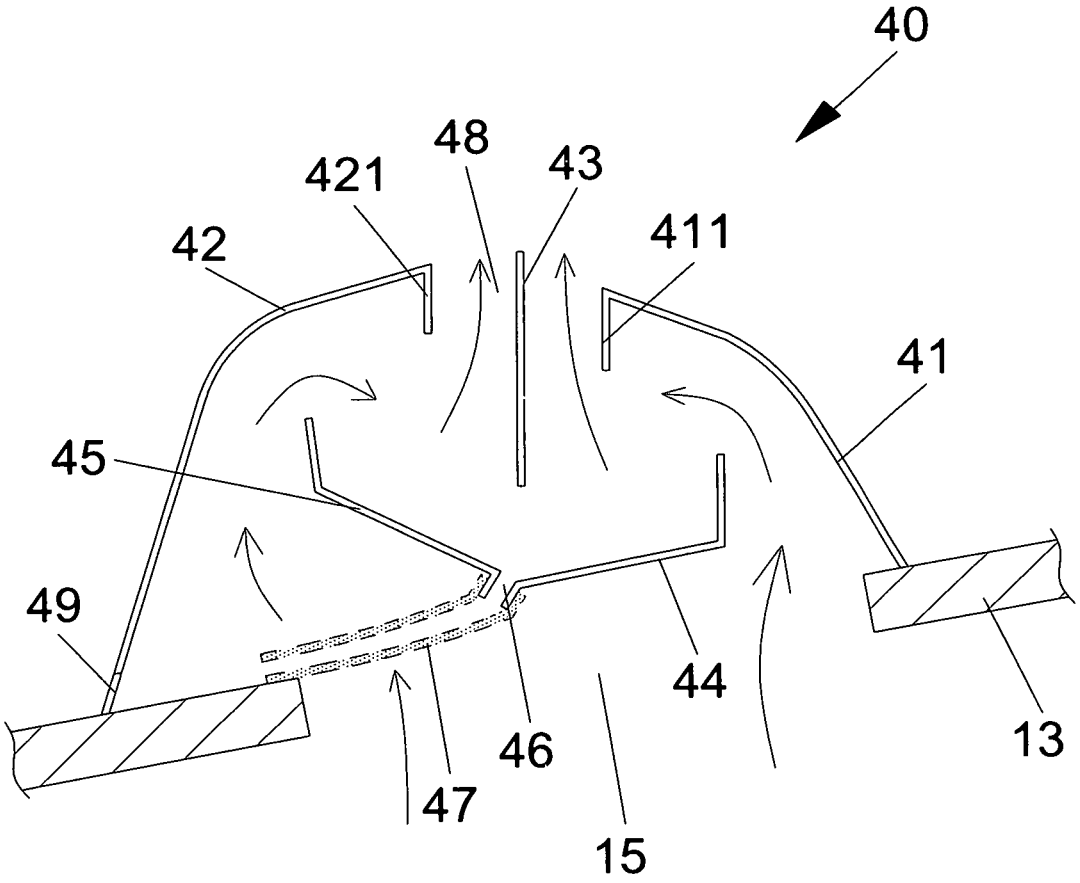
FIG. 6 is another cross sectional view showing the operation of the air circulation apparatus for the building according to the preferred embodiment of the present invention.
Figure 8:
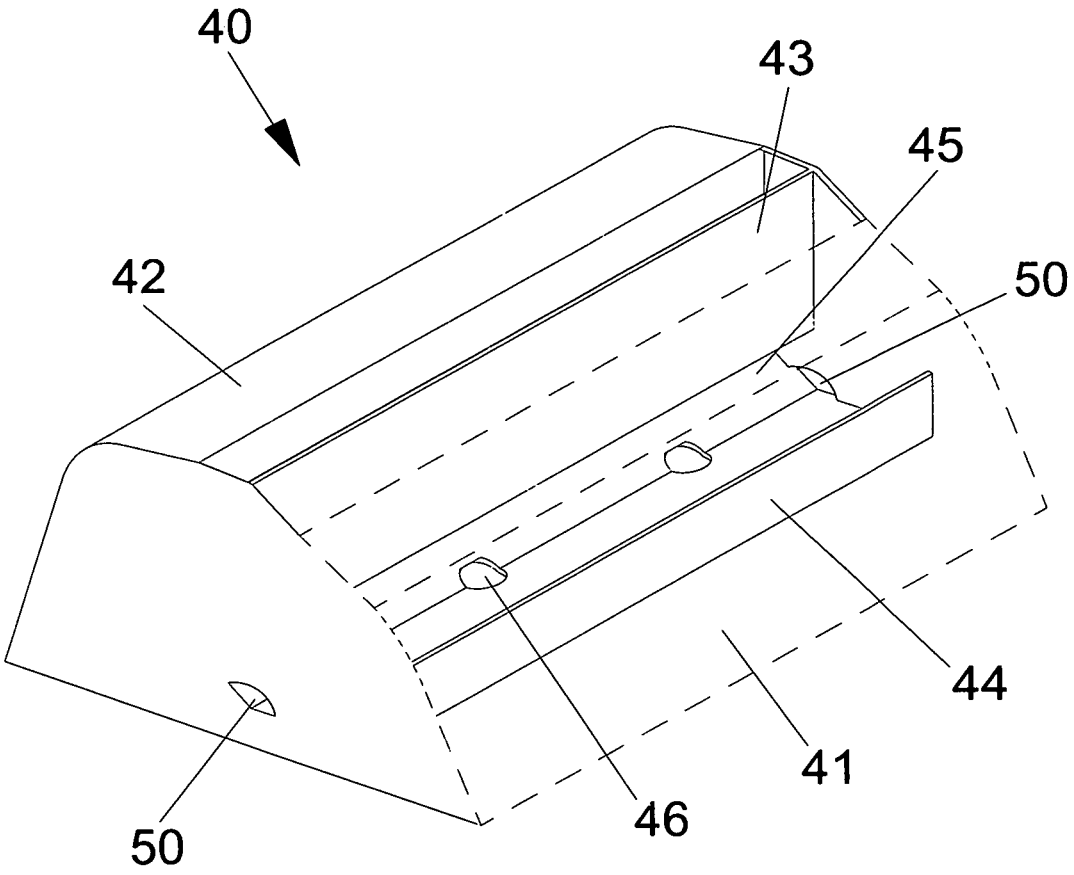
FIG. 8 is a perspective view showing the assembly of a part of the air circulation apparatus for the building according to the preferred embodiment of the present invention.

Referring to FIGS. 6 and 8, the multiple second exhaust systems 40 are individually secured above multiple third openings 15 on two tilted faces of the roof 13, each of the multiple second exhaust systems 40 includes a first lid 40 and a second lid 42 which are arranged beside each of the multiple third openings 15, wherein the first lid 41 has a first extension 411 extending downward from a top thereof, and the second lid 42 has a second extension 421 extending downward from a top thereof. Each second exhaust system 40 further includes a second orifice 49 defined on a bottom of the second lid 42, a fifth partition 43 defined on a central position of the first extension 411 and the second extension 421, a first accommodation plate 44 and a second accommodation plate 45 which are located below the fifth partition 43, a third orifice 46 formed between bottoms of the first accommodation plate 44 and the second accommodation plate 45, two fourth orifices 50 respectively defined on two ends of each second exhaust system 40 between the fifth partition 43 and the first accommodation plate 44, and a discharge pipe 47 connected with the third orifice 46 and the second orifice 49. Preferably, a diameter of each third opening 15 is more than When the hot airs flow into each third opening 15 from the building 10, they are separated by the first accommodation plate 44 and the second accommodation plate 45 and flow out of two fourth openings 48 among the fifth partition 43, the first extension 411, and the second extension 421 via a fourth channel among the first lid 41, the fifth partition 43, and the first accommodation plate 44 and via a fifth channel among the fifth partition 43, the second lid 42, and the second accommodation plate 45, thus exhausting the hot airs efficiently.

Figure 7:
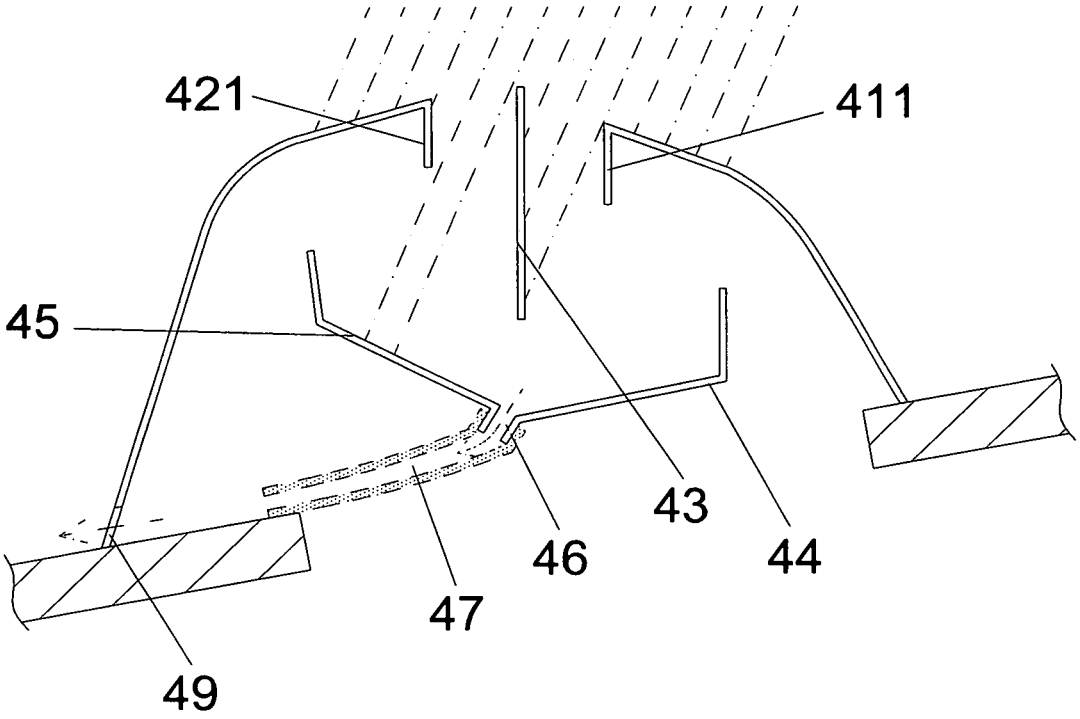
FIG. 7 is also another cross sectional view showing the operation of the air circulation apparatus for the building according to the preferred embodiment of the present invention.

As shown FIGS. 7 and 8, when the rainwaters spray into the two fourth openings 48 in the rainy day, they are separated by the first extension 411, the second extension 421, and the fifth partition 43 and drop on the first accommodation plate 44 and the second accommodation plate 45, then the rainwaters discharge out of the two fourth orifices 50 from the third orifice 46 via the discharge pipe 47 and the second orifice 49, thus discharging the rainwaters effectively.

While the preferred embodiments of the invention have been set forth for the purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. An air circulation apparatus being fixed on a building and comprising: multiple intake systems, a first exhaust system, and multiple second exhaust systems;

the multiple intake systems being mounted on an external wall of the building, the first exhaust system being arranged on a top of a roof of the building, and the multiple second exhaust systems being respectively secured on two tilted faces of the roof beside the top of the roof;

wherein each of the multiple intake systems includes a first cover disposed above an inlet of the external wall of the building, a second cover mounted below the inlet of the external wall of the building, an entrance defined between the first cover and the second cover, a first partition mounted on a central position of the entrance, a second partition vertically connected with the first partition proximate to the inlet, a water guide sheet arranged on an upper portion of the external wall of the building outside the inlet, and a water outlet formed on a bottom of the second cover;

wherein the first exhaust system includes two shells respectively arranged outside two sides of a first opening on the top of the roof, two first orifices individually defined on bottoms of the two shells, a third partition secured on a central position of the two shells, two fourth partitions obliquely extending downward from a bottom of the third partition, and two opposite fifth partitions respectively arranged parallel to the two shells and located proximate to the first opening, wherein two second openings are formed beside the third partition;

wherein each of the multiple second exhaust systems includes a first lid and a second lid which are arranged beside each of multiple third openings on two tilted faces of the roof, wherein the first lid has a first extension extending downward from a top thereof, and the second lid has a second extension extending downward from a top thereof; each second exhaust system further includes a second orifice defined on a bottom of the second lid, a fifth partition defined on a central position of the first extension and the second extension, a first accommodation plate and a second accommodation plate which are located below the fifth partition, a third orifice formed between bottoms of the first accommodation plate and the second accommodation plate, two fourth orifices respectively defined on two ends of each second exhaust system between the fifth partition and the first accommodation plate, and a discharge pipe connected with the third orifice and the second orifice.

2. The air circulation apparatus as claimed in claim 1, wherein a diameter of the entrance is less than the inlet.

3. The air circulation apparatus as claimed in claim 1, wherein a diameter of the first opening is more than each of the two second openings beside the third partition.

4. The air circulation apparatus as claimed in claim 1, wherein a diameter of each third opening is more than each of the two second openings.

* * * * *